US010773291B2

(12) United States Patent
Lakshman

(10) Patent No.: US 10,773,291 B2
(45) Date of Patent: Sep. 15, 2020

(54) UNIVERSAL RADIUS FORMING SYSTEM

(71) Applicant: Polyurethane Products, Addison, IL (US)

(72) Inventor: Govind Lakshman, Oak Brook, IL (US)

(73) Assignee: Polyurethane Products, Addison, IL (US)

( * ) Notice: Subject to any disclaimer, the term of this patent is extended or adjusted under 35 U.S.C. 154(b) by 316 days.

(21) Appl. No.: 15/982,786

(22) Filed: May 17, 2018

(65) Prior Publication Data

US 2019/0351472 A1 Nov. 21, 2019

Related U.S. Application Data

(60) Provisional application No. 62/510,593, filed on May 24, 2017.

(51) Int. Cl.
*B21D 22/26* (2006.01)

(52) U.S. Cl.
CPC ..... *B21D 22/26* (2013.01)

(58) Field of Classification Search
CPC ..... B21D 22/10; B21D 22/12; B21D 24/02; B21D 28/18; B21D 5/01; B21D 22/06; B21D 37/02; B21D 37/10; B21D 5/0272; B21D 22/02; B21D 22/26; B30B 15/024; B30B 15/061
USPC ..... 72/465.1, 466.8, 469, 473
See application file for complete search history.

(56) References Cited

U.S. PATENT DOCUMENTS 1,012,401 A * 12/1911 McCullough ..... B21D 22/10 72/57
2,565,949 A * 8/1951 Clifford ..... B29C 51/28 264/291
3,276,239 A 11/1966 Achler et al.
3,533,256 A * 10/1970 Hurek ..... B21D 22/12 72/63
4,295,352 A * 10/1981 Stokes ..... B21D 22/10 72/466.8
4,550,585 A * 11/1985 Sasaki ..... B21D 22/22 72/351
4,689,979 A * 9/1987 Otsuka ..... B21D 22/22 72/57
5,081,859 A 1/1992 De Smet
5,255,550 A * 10/1993 Dittlo ..... B21D 22/10 29/421.1
5,599,565 A * 2/1997 Dittlo ..... B21D 22/10 425/384
6,450,004 B1 9/2002 Edmondson et al.

FOREIGN PATENT DOCUMENTS

DE 4326033 C1 * 11/1994 ..... B28B 3/003
FR 2253581 A1 * 7/1975 ..... B21D 22/10
FR 2462262 A1 * 2/1981 ..... B21D 22/10

* cited by examiner

*Primary Examiner* — Teresa M Ekiert
*Assistant Examiner* — Jared O Brown

(57) ABSTRACT

A universal radius metal forming system wherein a bottom die elastomer is used on a sheet metal bending machine or press brake. The bottom die includes a forming pad used in combination with a wear pad to form virtually any radius in any type of metal. The forming pad includes a bottom cavity that is sized according to the volumetric relationship with the press punch. The wear pad is designed and coupled to the forming pad according to the gauge and shape of the metal being bent.

16 Claims, 10 Drawing Sheets

UNIVERSAL RADIUS FORMING SYSTEM

CROSS-REFERENCE TO RELATED APPLICATION

This application claims the benefit of U.S. Provisional Patent Application No. 62/510,593 filed May 24, 2017, which is hereby incorporated by reference in its entirety herein.

BACKGROUND OF THE INVENTION

I. Field of the Invention

The present disclosure relates generally to female press brake dies for use with large, heavy duty powered metal forming equipment, and more specifically to bottom die elastomers for radius forming on a sheet metal bending machine or press brake.

II. Description of the Prior Art

Press brakes are conventionally used in metal forming, particularly for forming bends in relatively large and/or thick sheets of metal. Such brakes are almost universally actuated by hydraulics, but may be powered by other means (mechanical, electromechanical, etc.) as desired. These brakes commonly have a relatively fixed lower table or bed which carries a metal forming die (or series of dies), and a relatively movable upper ram which holds a series of complementary punches. When the machine is actuated, the ram with its punches is forced downwardly into the die or dies, bending any metal placed therebetween.

More particularly, in order to bend sheet metal on a press brake, the conventional method is to use a steel punch with a matching steel bottom die. The punch is usually the upper portion, convexly shaped with a radius slightly smaller than the desired inside radius of a sheet metal being bent. The mating die is usually the bottom portion, concavely shaped with a radius equal to the radius of the matching punch plus the thickness of the sheet metal being bent. Typically, such matching punch and die are made from tool steel machined for each specific radius on a given type (i.e. stainless steel, mild steel, aluminum, etc.) or thickness of sheet metal. Machining of these matching convex and concave shapes is very expensive.

Additionally, while bending a large radius by such tooling, it will be understood that the radius at the closed position of the punch and die determines the radius of the bend, however, when the pressure is released the sheet metal may spring back to end up with a larger radius. The amount of spring back is related to the tensile strength and the hardness of the sheet metal being bent. If the size after spring back is not the desired size, then both the punch and die have to be re-machined to produce the desired radius on the part being bent. This too is a very expensive process.

Conventionally, and as shown in prior art FIGS. 1 and 2, to bend a radius shape on a press brake 10, a steel convex shape punch 12 and a concave shaped die 14 are used as a matching set to position the sheet metal 16 in between. At the bottom of the stroke of the machine, the sheet metal gets bent to the desired shape. The punch has a radius 18 and the die has a radius 20. The die radius is that of the punch plus the thickness 22 of the metal to be shaped. When the pressure is released, the sheet metal likely springs back and the finished radius 24 on the sheet metal will be larger than the radius of the punch. If the sheet metal radius after spring back is not the same as the desired radius of the part being formed, both the punch and the die will have to be re-machined. This, again, is a very expensive process, mostly because the machining of the concave shape is very time consuming. This method requires making a matching punch and die for each radius size, and possibly re-machining both if the size does not match the desired size of the part.

A newer version of the radius bending application is shown in the prior art FIG. 3 wherein a steel punch 26 with the calculated radius, allowing for the spring back of the metal and placing a sheet metal on top of a sheet of rubber or urethane 28 and applying pressure on the punch pushing the sheet metal into the sheet of rubber or urethane, deforming it to take the shape of the punch and thus bending the sheet metal. Deflector bars 30 made of steel or aluminum are placed below the sheet of rubber or urethane to provide relief below the pad, so the sheet deflects into the air gap thus created. The complete assembly is to be placed inside a welded U-shaped steel box 32 functioning as a retainer. This method requires high tonnage, set up is very heavy to handle and is also very expensive for the limited size range that can be formed.

A further improved version of radius bending systems is shown in the prior art pad system of FIG. 4, which utilizes a molded rectangular urethane pad 34 with multiple relief holes 36 molded to the full length of the pad, thus reducing the forming tonnage. The pad is positioned inside a steel channel retainer 38 and block 40 sitting on top of deflector pads 42 made of hard grade urethane, in order to create air space for the main pad to deflect into. During use, filler rods or tubes 44 may be used within the relief holes 36, but they must be used in symmetry. This pad system works reasonably well. The problem is that the areas molded between the molded holes tend to crack easily which leads to failure of the forming pad. Additionally, the total stack height of this pad sitting on top of the deflector bars, and all of these fitting inside a steel channel retainer is an issue. Many machines do not have the open height on the press brake to accommodate this stack height.

The present disclosure overcomes the problems associated with the aforementioned conventional radius bending applications. Accordingly, it is a general object of this disclosure to provide an improved radius forming system for sheet metal.

It is another general object of the present disclosure to provide a universal radius forming system for bending virtually any radius in many thicknesses and types of metals, using the same bottom bending die.

It is a more specific object of the present disclosure to provide a bending die comprising a specific shape of urethane forming pad designed to form a variety of radii using the same pad as the bottom die on a sheet metal bending machine commonly known as a press brake.

It is another more specific object of the present disclosure to provide a pressure pad layered on top of the forming pad to enable multiple forming pressures as well as wear resistance for the forming pad.

These and other objects, features and advantages of this disclosure will be clearly understood through a consideration of the following detailed description.

SUMMARY OF THE INVENTION

According to an embodiment of the present disclosure, there is provided a radius forming system for bending sheet metal with a press brake that has a punch and a bottom die retainer. The system includes a pair of cooperating urethane pads whereby the bottom larger pad is dimensioned to fit within the bottom die retainer and includes a bottom cavity sized relative the size of the punch and the top flat pad is a heavier durometer and sits upon the larger pad. The pads are coupled to one another on one of the sides of the bottom pad According to another embodiment of the present disclosure, these is provided a sheet metal forming system for use in a bending machine having a press punch and a bottom die bed. The system includes a pair of cooperating urethane pads whereby the bottom larger pad is dimensioned to fit within the bottom die bed and includes a bottom cavity sized relative the size of the punch and the top flat pad is a heavier durometer and sits upon the larger pad. The pads are coupled to one another through the middle centerline of the press punch.

According to another embodiment of the present disclosure, there is provide a radius forming device for bending sheet metal with a press brake having a punch and a bottom die retainer. The system includes a pair of cooperating urethane pads whereby the bottom larger pad is dimensioned to fit within the bottom die retainer and includes a bottom cavity sized relative the size of the punch and the top flat pad is a heavier durometer and sits upon the larger pad. The pads are coupled to one another through the middle centerline of the press punch. The device is capable of heavier tonnage via the use of optional reinforcement rods located on the top of the first pad.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

In any event, in the present system, the bottom die is a urethane forming pad with a flat top surface that deflects and applies uniform pressure from the bottom to wrap the sheet metal tightly against the punch. The size and shape of the punch determines the size and shape of the sheet metal part that is bent. The urethane forming pad functions like a bladder of hydraulic fluid that deflects and conforms to the shape of the punch, and in the deflection process, exerts enormous uniform pressure against the punch, thus bending the sheet metal tightly against the radius of the punch. The same urethane pad can be used with a variety of punches to form virtually any radius with the same bottom die.

Urethane or polyurethane is the preferred elastomeric material for this application because of a variety of unique engineering properties of this elastomer. For example, high load bearing capacity, excellent wear resistance, elastic memory, excellent impact resistance, superior resistance to abrasion, tearing, cutting and availability in a variety of hardness. Urethane is therefore an ideal material for this application.

If the urethane forming pad is too soft, it will not be able to bend tougher and heavier gauge metals, as the metal will kink, instead of bending with a uniform arc radius. If the forming pad is too hard, the required tonnage for deflecting such a forming pad will be very high, especially in larger radius and longer bends. Most press brakes will not have such high tonnage to form tougher longer sheet metal. That said, the forming pad must be flexible in a large area, without requiring a higher amount of tonnage to deflect the pad, and at the same time it should be able to apply enough forming pressure to wrap the sheet metal around the punch.

To increase the forming pressure for heavier or tougher metals, a harder grade of urethane pad, a so-called pressure pad or wear pad is layered on top of the forming pad and is held adjacent and/or attached to the forming pad during the forming operation. The complete forming system comprises a forming pad, which is a flexible member shaped specifically to provide a built-in deflecting area for the pad to deflect into when the punch pushes down into this pad; and layered on top of this pad is a pressure or wear pad, usually made of a harder grade urethane designed to provide a much higher forming pressure, and is more wear resistant and able to apply more forming forces bending the sheet metal against the punch. In a preferred embodiment, the system includes a detachable pressure pad that moves with the sheet metal during the forming process and should be replaceable if it is damaged by the sharp edges of the sheet metal.

Figure 1A:
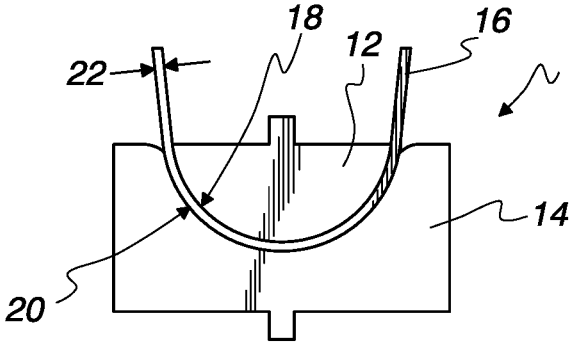
Fig. 1A (Prior Art)
FIG. 1*a* cross-sectional frontal view of the component parts of a conventional prior art press brake in the pressed position.
Figure 1B:
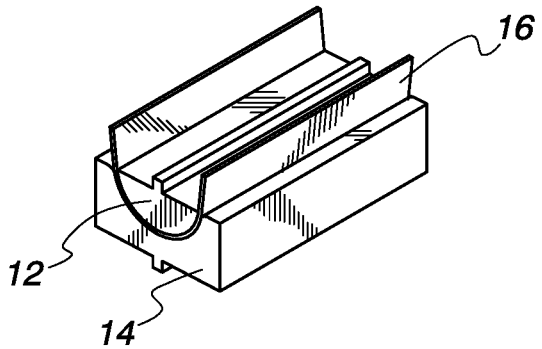
Fig. 1B (Prior Art)
FIG. 1*b* is a perspective view of the press brake of FIG. 1*a*.
Figure 2A:
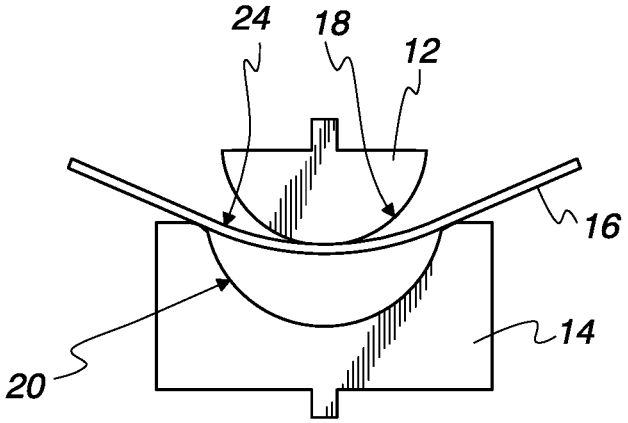
Fig. 2A (Prior Art)
FIG. 2*a* is a cross-sectional frontal view of the press brake of FIG. 1 in the released position.
Figure 2B:
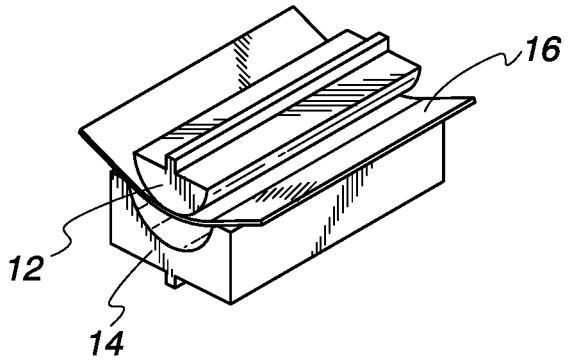
Fig. 2B (Prior Art)
FIG. 2*b* is a perspective view of the press brake of FIG. 2*a*.
Figure 3A:
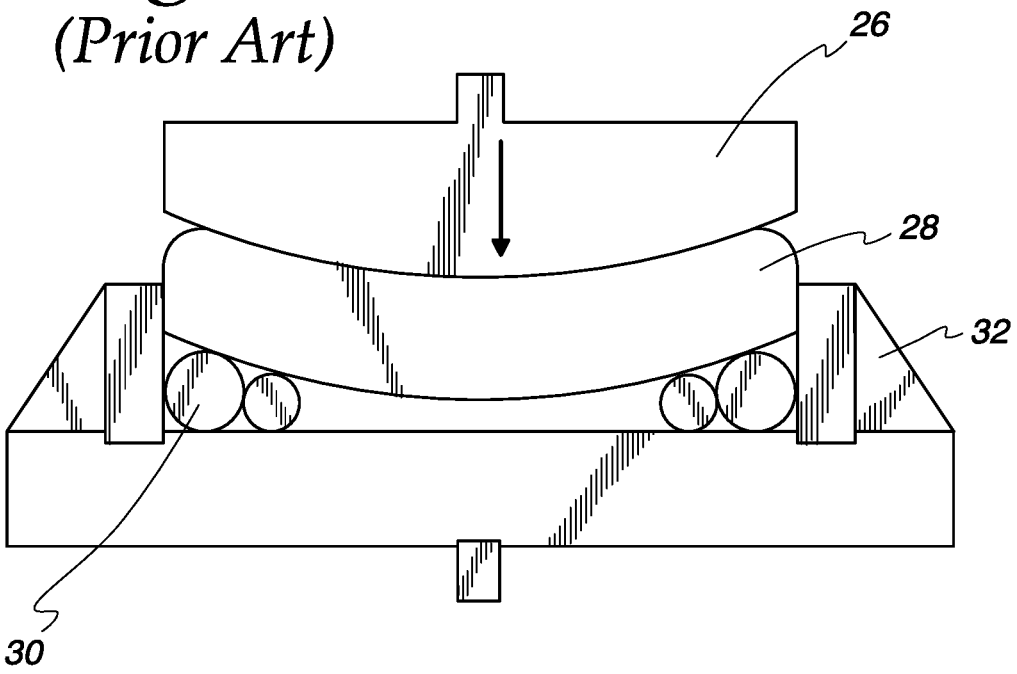
Fig. 3A (Prior Art)
FIG. 3*a* is a cross-sectional frontal view of the component parts of another prior art press brake.
Figure 3B:
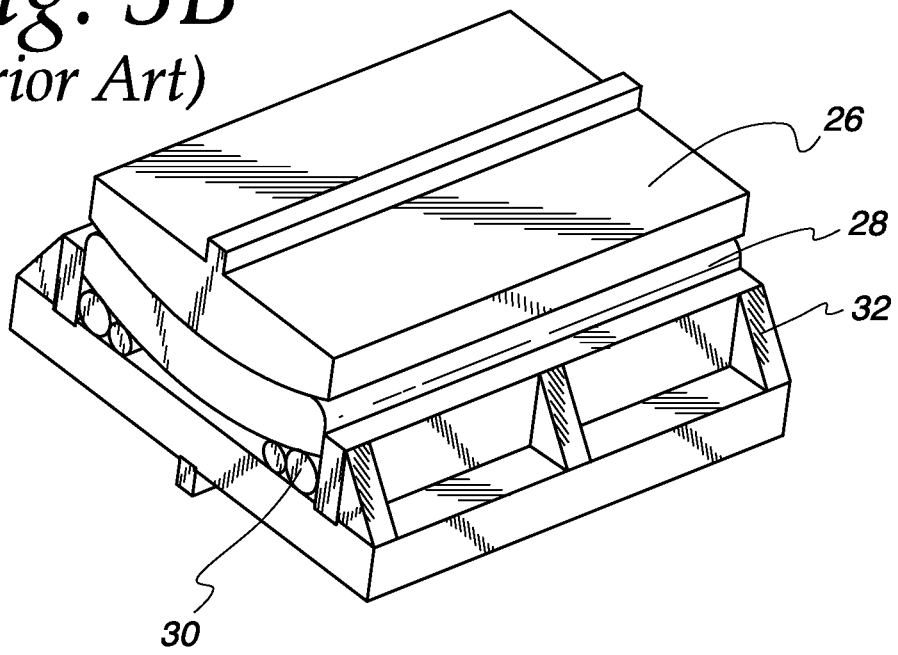
Fig. 3B (Prior Art)
FIG. 3*b* is a perspective view of the press brake of FIG. 3*a*.
Figure 4:
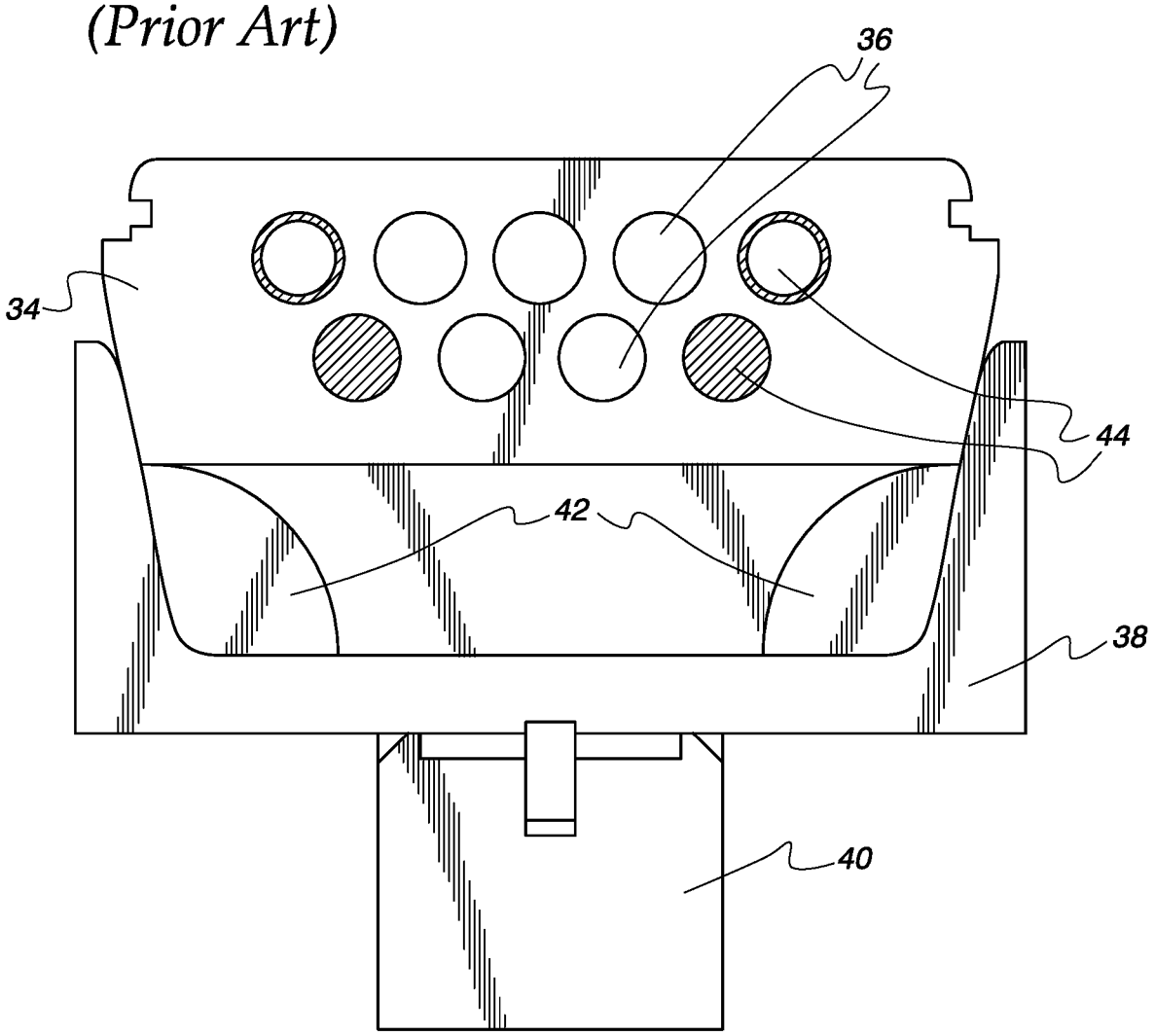
Fig. 4 (Prior Art)
FIG. 4 is a cross-sectional frontal view of the component parts of yet another prior art press brake.
Figure 5A:
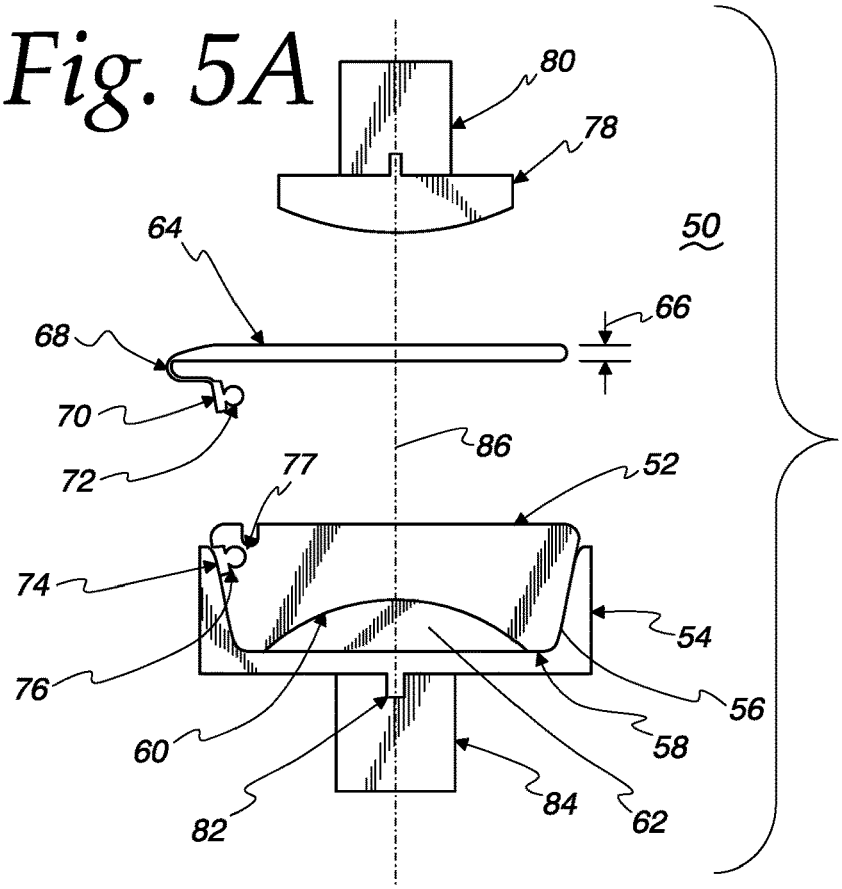
FIG. 5*a* is a cross-sectional partially exploded frontal view of the universal radius forming system according to the principles of an embodiment of the present disclosure.
Figure 5B:
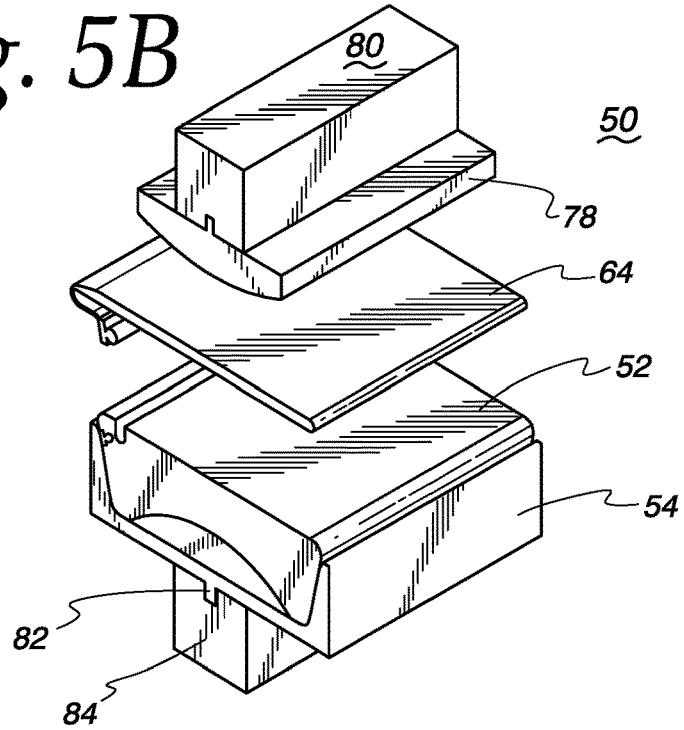
FIG. 5*b* is a perspective view of the radius forming system of FIG. 5*a*.

More particularly, and turning now back to the figures to more specifically describe the present disclosure, an embodiment of the universal radius forming system 50 is illustrated in the partially exploded cross-sectional view of FIG. 5*a* and associated perspective view of FIG. 5*b*. The urethane forming pad 52 is designed to fit in a preferably standard steel channel 54 to function as a holder or a retainer to position the bottom die on the bed of a press brake. The sides 56 and the bottom 58 of the forming pad are molded (dimensioned) to conform to the shape of the steel channel 54, which may be a commercially available C-channel retainer. The bottom 58 of the pad 52 has a molded concave shape 60, with a radius and height generally sized for the maximum size punch that a given pad is designed to bend. More particularly, the space 62 this creates under the pad is sized volumetrically proportional to the volume of the punch that will penetrate the forming pad. The shape of this space 62 is preferably a mirror image of the shape of the largest punch contour that the forming pad is designed to bend. The shape 60 of the bottom of the pad 52 is designed for easy deflection and to provide progressively increasing forming pressure on the punch as it descends into the forming pad 52.

The generally flat wear pad 64 is dimensioned to lay and is positioned on top of the forming pad 52 and is designed to provide a harder wear resistant forming surface. This wear pad is made of a material harder than the forming pad. The thickness 66 of the wear pad can be changed and is dependent on the thickness and the tensile strength of the sheet metal being formed. The wear pad 64 includes an overlapping curved loop section 68, having a thinner cross-section to provide easy deformation and allowing the wear pad 64 to flow into the forming arc length of the punch contour. The wear pad further includes a rectangular key 70 and a circular key 72 that are both molded integral with the wear pad 64. Matching rectangular slot 74 and circular slot 76 are molded integral with the forming pad 52. A deformation slot 77 which is rectangular in cross section with a half round bottom is also molded in the forming pad 52 provides easy deformation into the forming area without the wear pad pulling out of the key slots (74, 76).

Finally, the steel punch 78 is attached to the ram 80 of the press brake and the tang 82 mounts the steel channel 54 retainer to the bed 84 of the press brake. In use, the press brake compresses the aforementioned component parts as the ram 80 and bed 84 are pressed together down the centerline 86.

As such, the present disclosure pertains to bending sheet metal (stainless steel, mild steel, brass, bronze, copper, aluminum, etc.) into radius shapes using a universal bottom die. A plethora of radii can be formed with the same bottom die by merely changing the top steel punch radius. The maximum width of punch that can penetrate the forming pad is limited by the width of the forming pad. Staying within such a limitation, the desired radius is formed in one hit to form a ninety-degree (90°) bend or in three hits to form a U-shape or any size very large radii can be formed in sections by progressive bump forming hits. In any event, all forming hits are accomplished without any bump lines between formed sections. Since the sheet metal outside is being formed by urethane, there are no marks or damage of any kind to the finish of the sheet metal. So, pre-finished, pre-polished or pre-painted sheet metal can be formed without any damage to the outside finish. Accordingly, there is no need for secondary finishing operations. Even when forming perforated metal with large percentage openings, the sheet metal can be formed to the desired radial shapes without any kinks or distortions of the weak areas of the sheet metal.

Figure 6A:
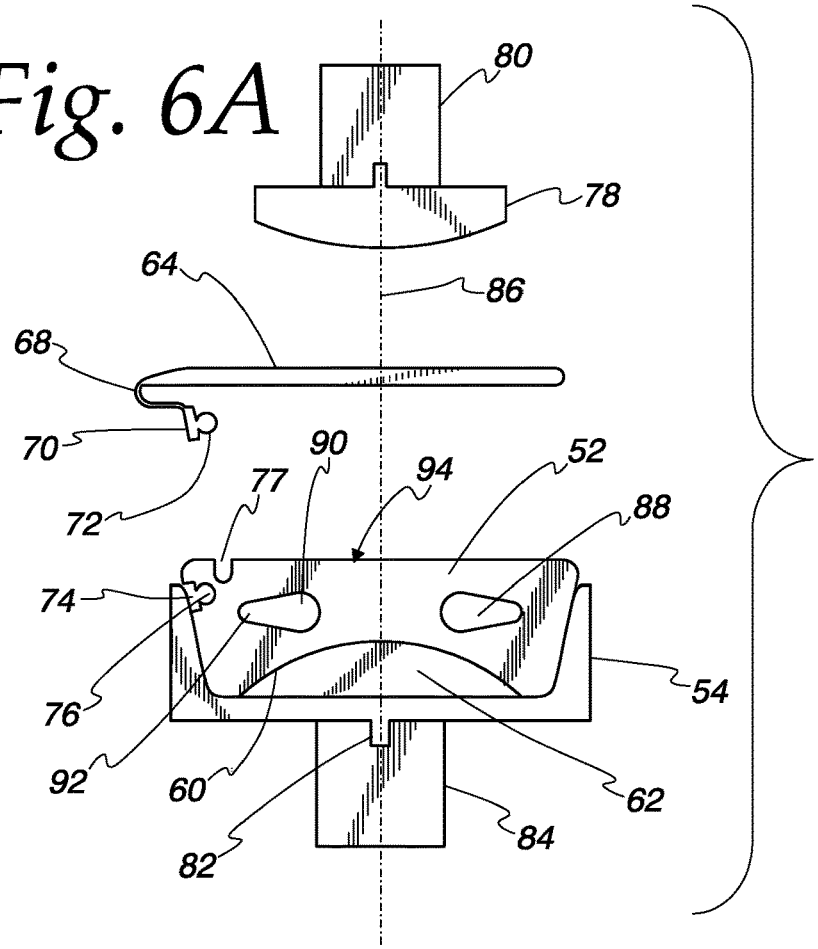
FIG. 6*a* is a cross-sectional partially exploded frontal view of the universal radius forming system according to the principles of another embodiment of the present disclosure.
Figure 6B:
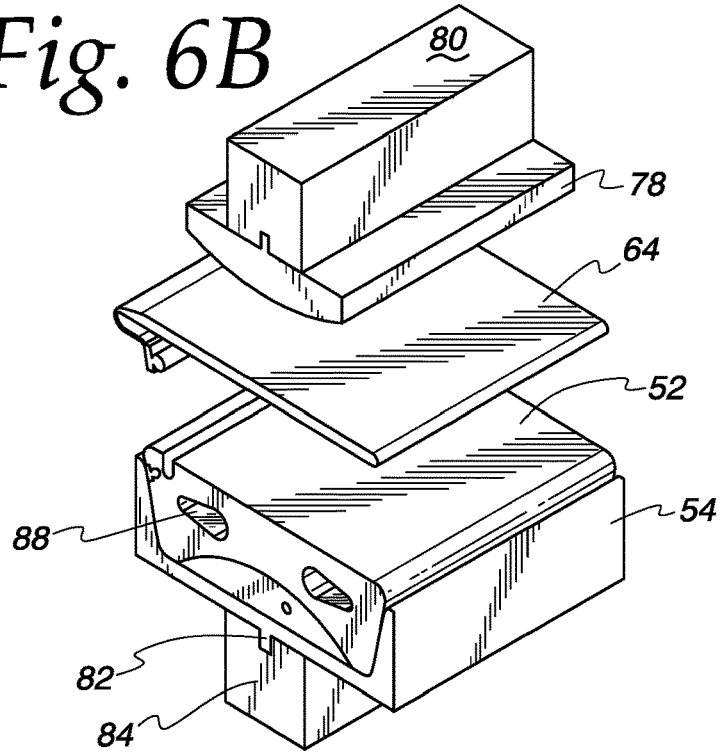
FIG. 6*b* is a perspective view of the radius forming system of FIG. 6*a*.

Another embodiment of the universal radius forming system of the present disclosure will be described through FIGS. 6 and 7. It will be noted that FIG. 6 is generally the same as FIG. 5 but for the added pair of molded holes 88 in the main forming pad 52. These holes are preferably symmetrically placed and shaped as tear-drops (or belt-drive shaped) with a larger diameter hole 90 towards the centerline 86 of the pad 52 and a smaller diameter hole 92 towards the outside edge of the pad. These holes 88 provide additional deflection space for the pad to deform for various sizes of punches that push into the forming pad 52. If in the teardrop shape, the larger diameter 90 closer to the center line 86 will deflect more easily to the descending radius punch, and the smaller diameter 92 towards the outer edge of the punch will be exerting a progressively increasing forming pressure against the descending punch. It will be appreciated that there are many possible shapes and locations for these relief holes that can be molded to accomplish the same purpose. If for some application, there is a need for higher forming pressure, these holes (and in the illustrated teardrop shape the smaller diameter 92) can be filled with urethane (or otherwise) rods, and the like, of the same or harder durometer. Essentially, this embodiment enables the forming pad 52 to deflect easily requiring less tonnage to deflect the forming pad, as compared to the embodiment shown in FIG. 5, while adding flexibility and adjustability of forming pressures.

In any event, and once again, the main forming pad 52 is molded in a cast urethane compound shaped and sized to fit inside a steel channel retainer 54. The top surface 94 of the pad 52 is flat, and the bottom side 60 has a molded concave shape that provides a cavity 62 for the forming pad 52 to deflect into when the punch penetrates. Positioned on top of the forming pad 52 is a pressure pad 64, which is made of a higher grade of urethane. The pressure pad 64 is held anchored in the backside of the forming pad by a combination rectangular 70 and round 72 key molded in the wear pad, which are in turn press fit into the matching shapes (74, 76) molded in the forming pad 52.

During the forming process, the punch 78 makes contact with the sheet metal first on the centerline 86, and as it pushes the sheet metal down, the sheet metal as well as the pressure pad are deformed into an arc shape, and the pressure pad and the sheet metal are dragged into the formed arc shape. The length of the wear pad from the centerline to the outside edge of the arc at the bottom of the stroke is considerably more than the length at the beginning of the forming process when the pressure pad was flat. The extra length of the pressure pad is provided in the shape of a loop 68 at the backside. As the pressure pad is dragged into the forming area, because of the retractable design of the loop 68, the extra material in this loop 68 moves into the forming area as the punch pushes the sheet metal into the forming pad. The vertical molded slot 77 in the back of the forming pad helps in the deflection of the main pad, without the pressure pad pulling out of the retaining key slots.

Figure 7A:
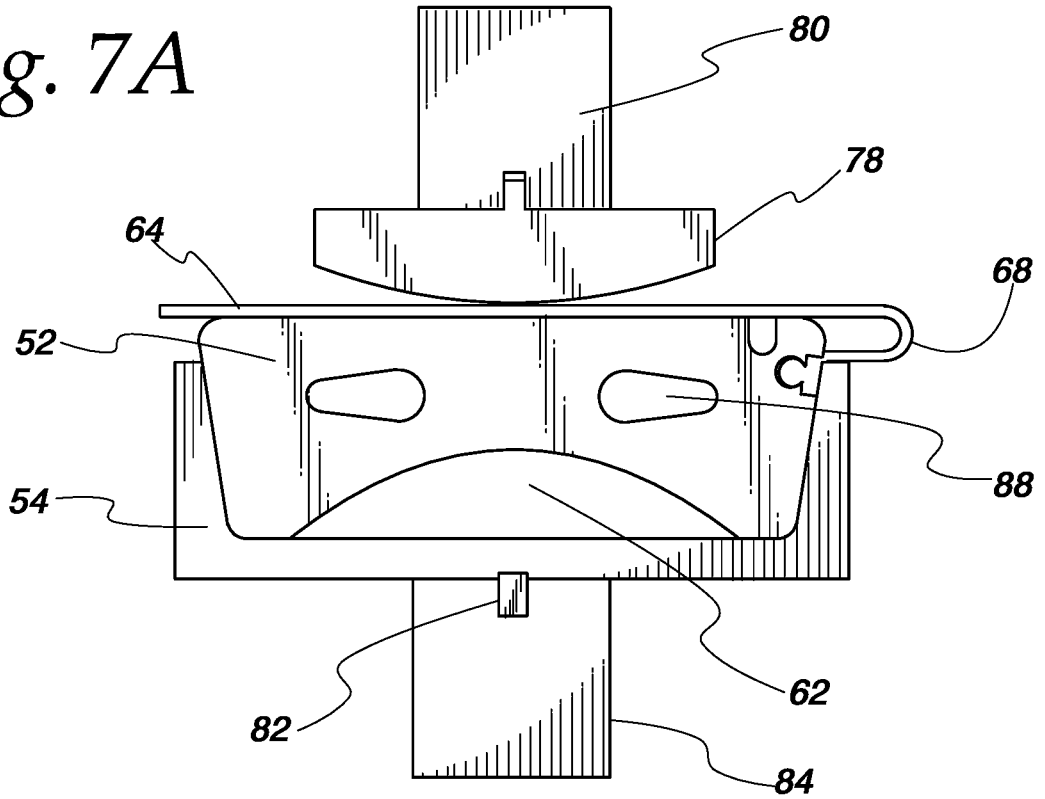
FIG. 7*a* is a frontal view of the universal radius forming system of FIG. 6*a* in the released position.
Figure 7B:
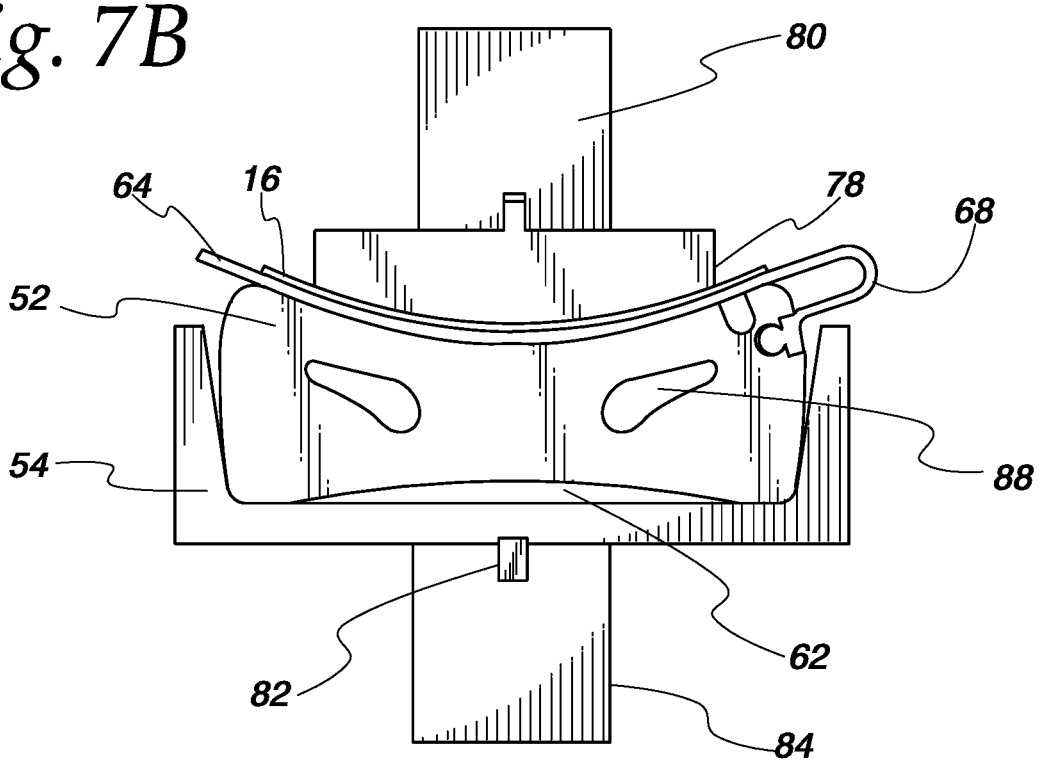
FIG. 7*b* is a frontal view of the universal radius forming system of FIG. 7*a* in the pressed position.

FIG. 7 illustrates the embodiment of FIG. 6 in use. In particular, FIG. 7*a* shows the press brake and the universal radius forming system in the released position while FIG. 7*b* shows the press brake and universal radius forming system in the pressed position. The ram 80 directs the punch 78 towards the tang 82 and bed 84 of the press brake through the universal radius forming system positioned within the channel retainer 54. The universal radius system starts in the released/ready position/state of FIG. 7*a*, is temporarily transformed during the pressed/bending position/state of FIG. 7*b*, and then returns to the state of FIG. 7*a* for the next use of the brake. As the sheet metal 16 is pressed in FIG. 7*b* the forming pad 52 is compressed and the cavity 62 and relief holes 88 are squeezed while the wear pad 64 and loop 68 are deformed as previously described.

Figure 8A:
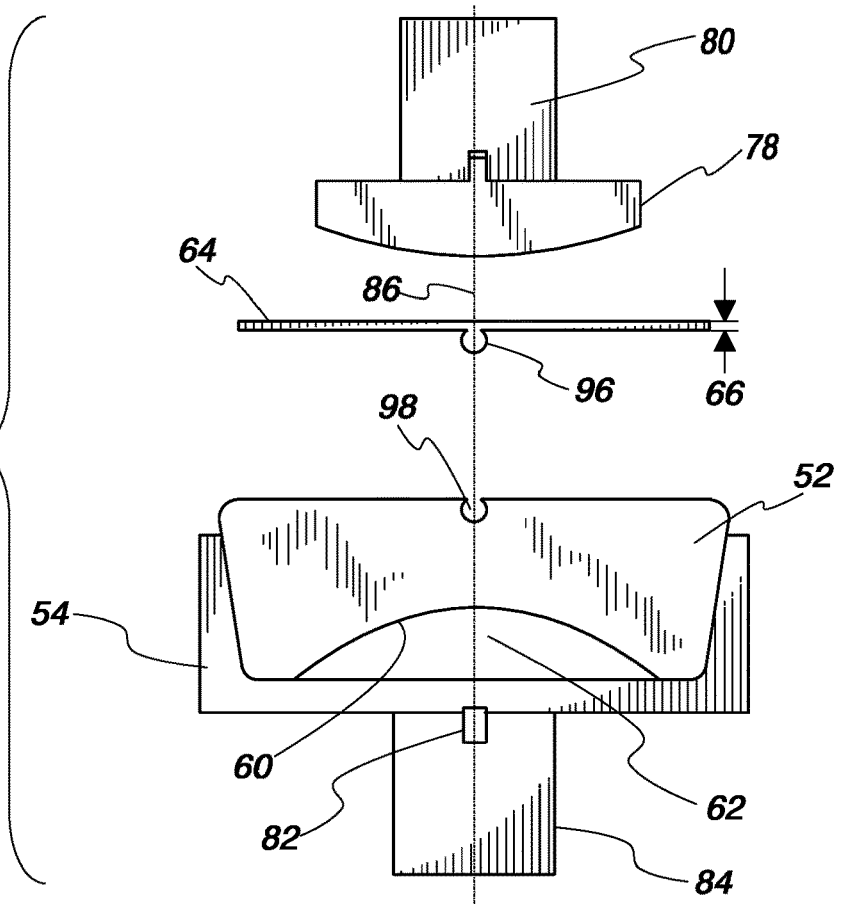
FIG. 8*a* is a cross-sectional partially exploded frontal view of the universal radius forming system according to the principles of another embodiment of the present disclosure.
Figure 8B:
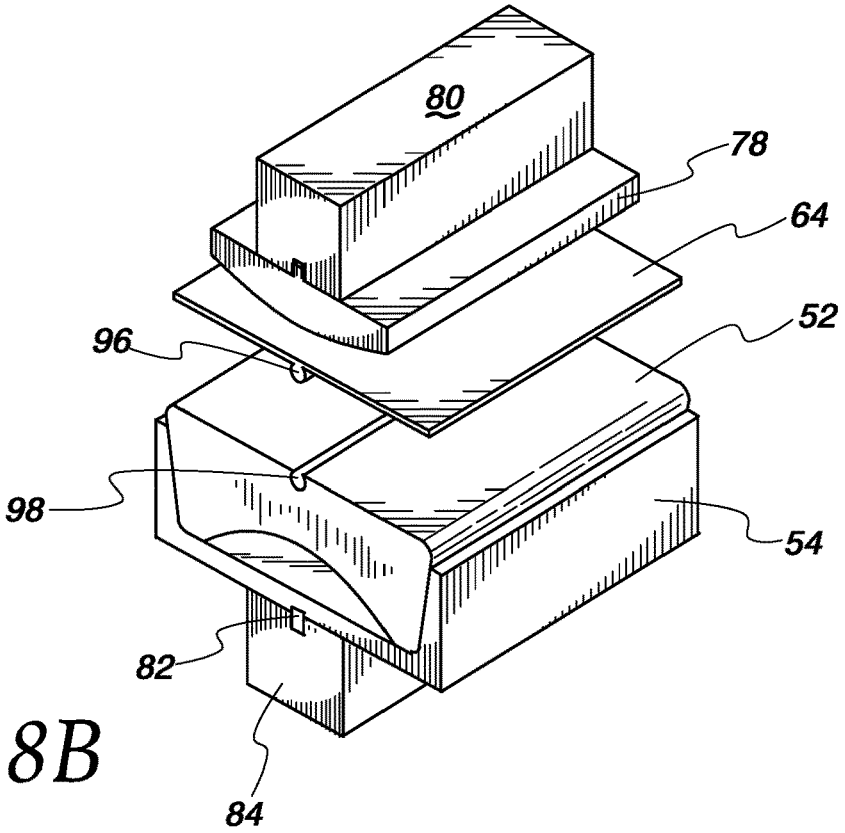
FIG. 8*b* is a perspective view of the radius forming system of FIG. 8*a*.

In order to bend sheet metal of a heavier gauge or of a higher tensile strength, which requires more forming pressure to bend the sheet metal or plate, the embodiment of FIG. 8 may be utilized. Such heavier sheet metal may have sharp edges that can cut into and damage the forming pad during the bending operation. As such, a urethane wear pad (or pressure pad) of a harder durometer urethane than the forming pad is designed for reducing the damage to the main forming pad. This pressure pad has to be flexible enough to deflect and bend along with the forming pad to bend the sheet metal against the exact contour of the steel punch, and then must return to its original position after the forming pressure is released. To accomplish this continuous and flexible engagement, a circular key-way is molded at the bottom of the pressure pad, along the centerline of the pressure pad, so that it snaps into a matching circular shaped groove that is molded in the forming pad. This design enables the deflecting of the pressure pad in conjunction with the radius shape of the punch, where the contact between the forming punch and the bottom die pad start as a line contact along the center line, and as the punch descends into the forming die, the urethane pressure pad wraps the sheet metal tightly against the punch, progressively moving outwards from the centerline. The forming pad has to be flexible and the pressure pad has to be rigid enough to uniformly bend the sheet metal around the punch. Depending on the tensile strength of the metal being formed, the hardness and the thickness of the pressure pad can be varied to accomplish the desired forming pressure. The harder grade of the pressure pad is also more wear resistant for forming sheet metals with higher thicknesses or with sharp edges or odd shapes. This design is a preferred method for providing a pressure pad, anchored in the middle wherein a much harder grade of pressure pad is required. Harder pressure pads will be required when bending sharper edged sheet metal or odd shaped sheet metal, or sheets with cut-outs within the sheet.

More particularly, and turning now to FIG. 8, the main forming pad 52 is molded in a preferably cast urethane compound and is shaped and sized to fit inside a steel channel retainer 54. The top surface of the forming pad is flat and the bottom has a molded concave shaped air cavity 62 that provides a space for the forming pad to deflect into when the punch 78 penetrates the forming pad 52. This air cavity 62 below the pad is sized volumetrically proportional to the volume of the largest size punch that will penetrate the forming pad 52. Indeed, this air cavity below the forming pad is a mirror image of the shape of the largest size punch contour that the forming pad is designed to bend. The concave shape of the bottom side 60 of the pad is for easy deflection of the pad 52 as well as to provide a progressively increasing forming pressure on the punch 78 as it descends into the pad 52. The wear pad 64 is positioned on top of the forming pad 52 and is designed to provide a harder wear resistant forming surface. This wear pad 64 is made of a material harder than the forming pad 52. The thickness 66 can be varied as is dependent upon the thickness and tensile strength of the sheet metal that is being formed. A circular key-way 96 is molded at the bottom of the pressure pad, along the centerline of the pressure pad, so that it snaps into a matching circular shaped groove 98 that is molded in the forming pad. The hardness of the pad can be changed to vary the forming pressure as well as the wear resistance characteristic of the pad. During the forming process, the punch 78 makes contact with the sheet metal first on the centerline 86 and as it pushes the sheet metal down, the sheet metal is deformed into an arc shape starting at that centerline and going outwards.

Figure 9A:
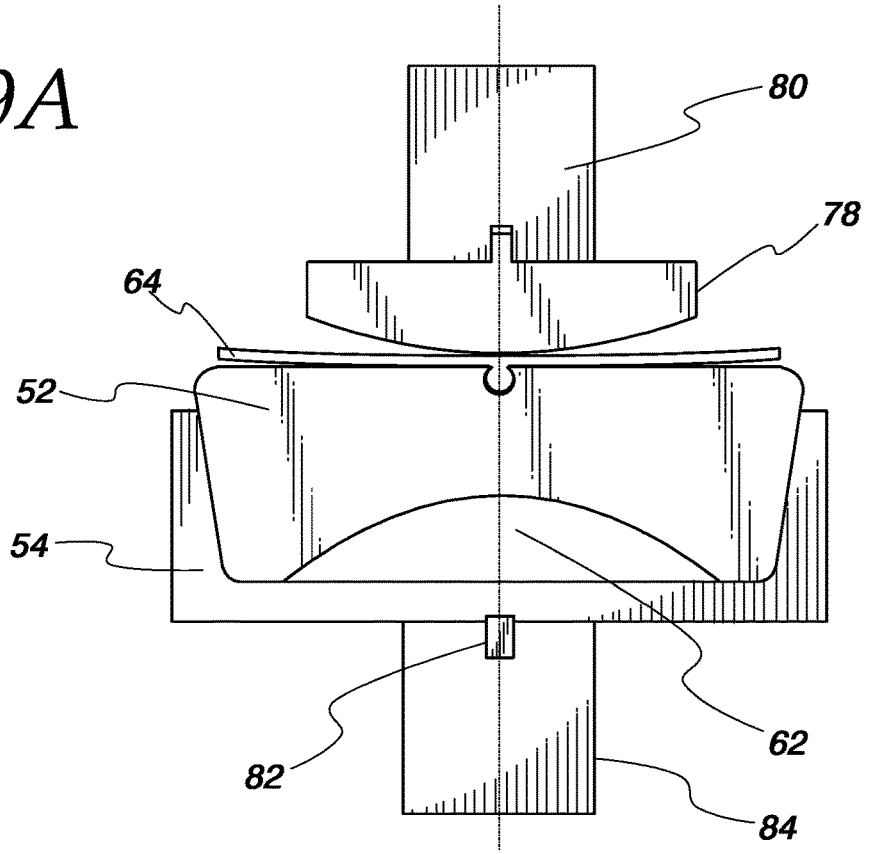
FIG. 9*a* is a frontal view of the universal radius forming system of FIG. 8*a* in the released position.
Figure 9B:
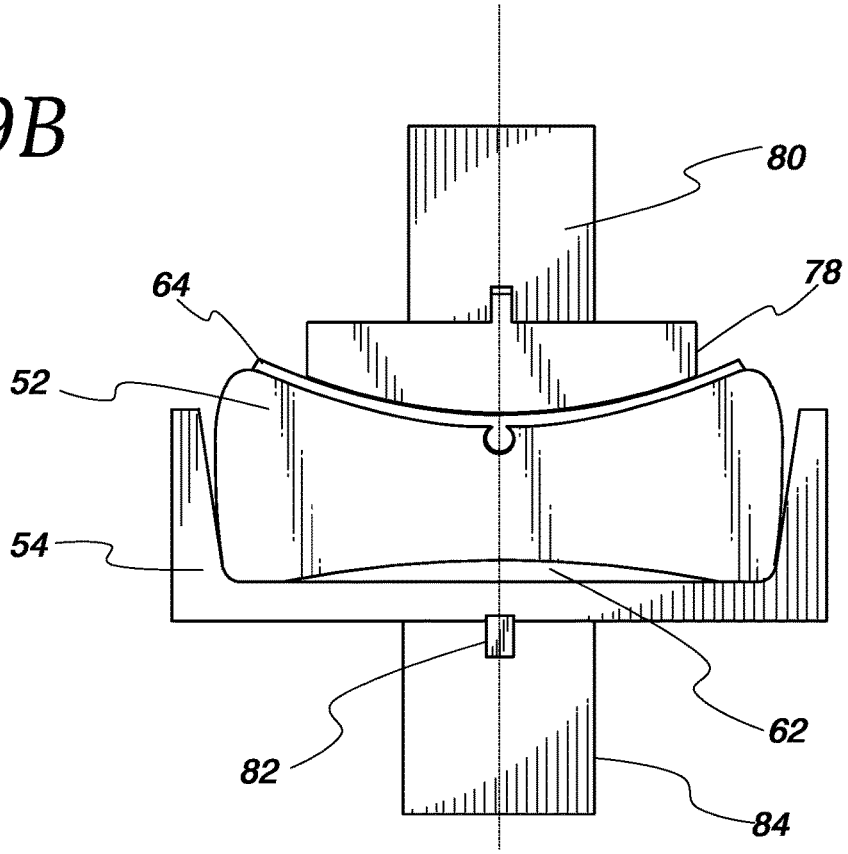
FIG. 9*b* is a frontal view of the universal radius forming system of FIG. 9*a* in the pressed position.

FIG. 9 illustrates the embodiment of FIG. 8 in use. In particular, FIG. 9*a* shows the press brake and the universal radius forming system in the released position while FIG. 9*b* shows the press brake and universal radius forming system in the pressed position. The ram 80 directs the punch 78 towards the tang 82 and bed 84 of the press brake through the universal radius forming system positioned within the channel retainer 54. The universal radius system starts in the released/ready position/state of FIG. 9*a*, is temporarily transformed during the pressed/bending position/state of FIG. 9*b*, and then returns to the state of FIG. 9*a* for the next use of the brake. As the system is pressed in FIG. 9*b* the forming pad 52 is compressed and the cavity 62 is squeezed while the wear pad 64 is deformed as previously described.

Figure 10A:
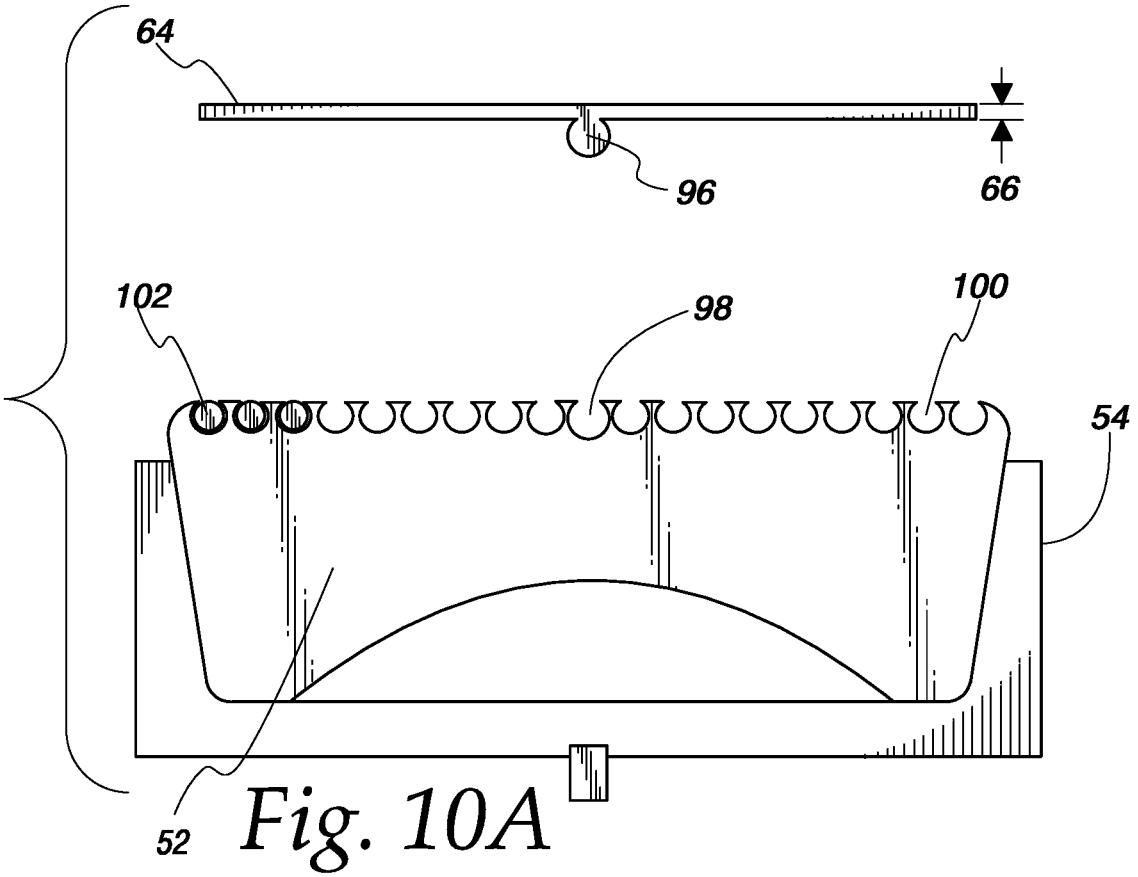
FIG. 10*a* is a cross-sectional partially exploded frontal view of the universal radius forming system according to the principles of another embodiment of the present disclosure.
Figure 10B:
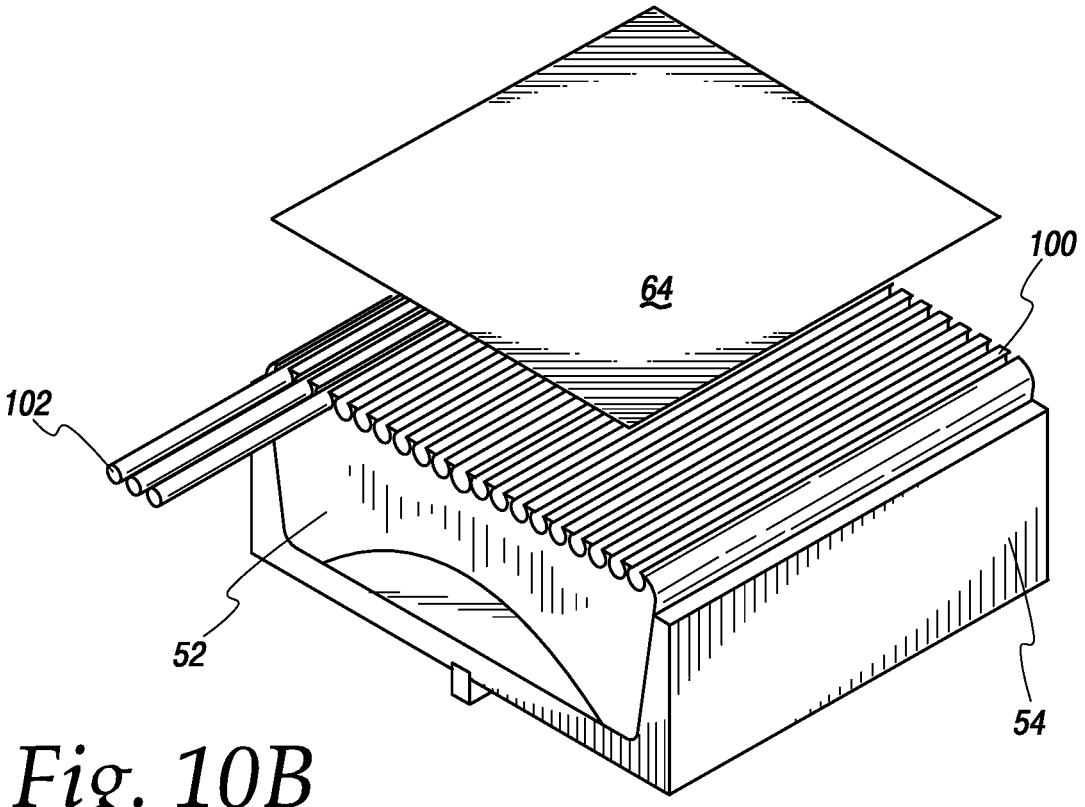
FIG. 10*b* is a perspective view of the radius forming system of FIG. 10*a*.

In order to bend sheet metal of an even heavier gauge or of an even higher tensile strength, which requires more forming pressure to bend the sheet metal or plate, the embodiment of FIG. 10 may be utilized. The main pad 52 is molded in a flexible and softer cast urethane compound shaped and sized to fit a steel channel retainer 54. The top surface of the forming pad 52 includes molded circular slots 100 which may house steel rods 102. In order to further increase the forming pressure, these round tool steel rods 102 are inserted into the round cavities 100 and have a small gap between each rod so that when the top surface of the forming pad flexes, these rods will also flex and at the same time apply high forming pressure against descending punch. During the forming process, the punch makes contact with the sheet metal first on the centerline and as it pushes the sheet metal down the sheet metal as well as the pressure pad and the full row (if inserted) of steel rods below the pressure pad are deformed into an arc shape and the pressure pad along with the steel rods and the sheet metal are progressively formed into the arc shape, starting with the centerline and going outwards. Once again, in this embodiment, in order to protect the top surface of the pad 52 from cutting by sharp edges, a wear or pressure pad 64 made of a very hard grade urethane can be used. As before, this wear pad 64 has a molded key 96 that snaps into a key slot 98 molded in the center line of the forming pad 52. This key 96 and matching slot 98 enables compressively holding the pressure pad in place during the forming/bending operation.

Figure 11A:
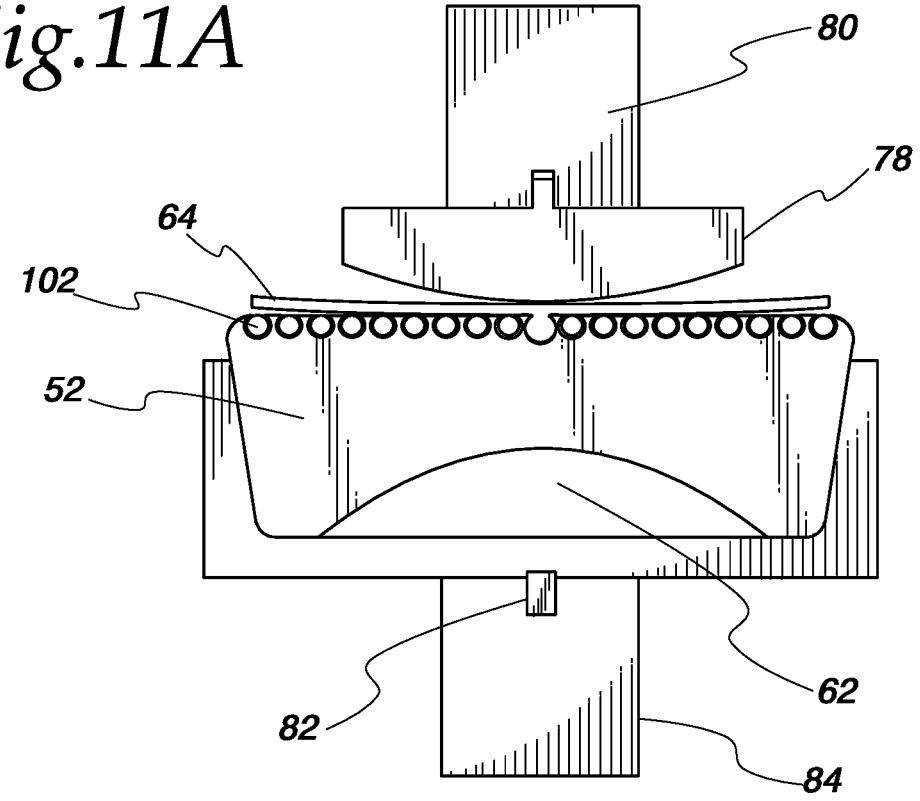
FIG. 11*a* is a frontal view of the universal radius forming system of FIG. 10*a* in the released position.
Figure 11B:
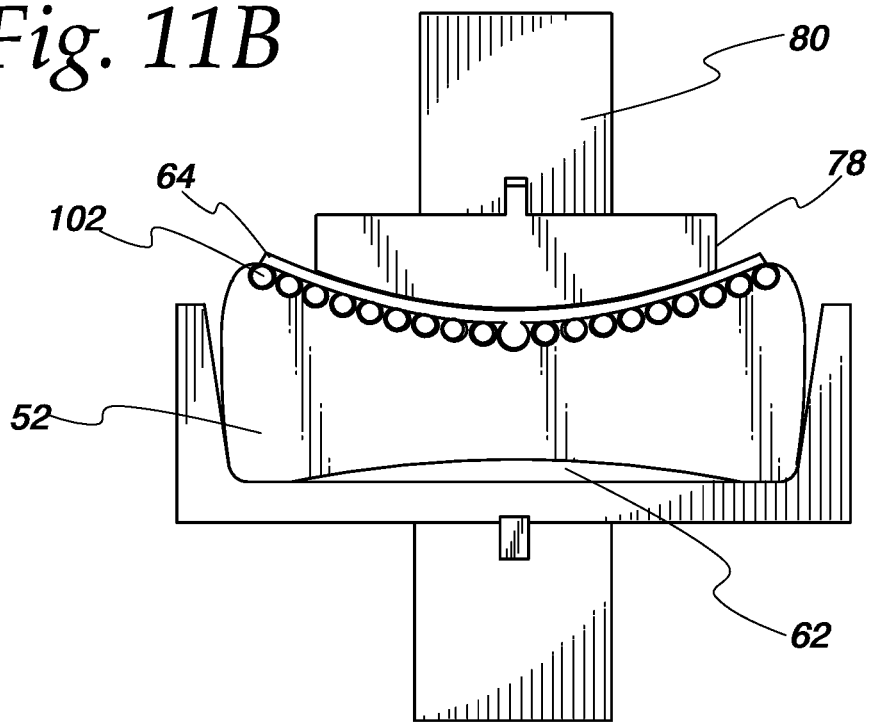
FIG. 11*b* is a frontal view of the universal radius forming system of FIG. 11*a* in the pressed position.

FIG. 11 illustrates the embodiment of FIG. 10 in use. In particular, FIG. 11*a* shows the press brake and the universal radius forming system in the released position while FIG. 11*b* shows the press brake and universal radius forming system in the pressed position. The press directs the punch 78 through the universal radius forming system. The universal radius system starts in the released/ready position/state of FIG. 11*a*, is temporarily transformed during the pressed/bending position/state of FIG. 11*b*, and then returns to the state of FIG. 11*a* for the next use of the brake. As the system is pressed in FIG. 11*b* the forming pad 52 is compressed and the cavity 62 is squeezed while the wear pad 64 is deformed as previously described.

Yet another embodiment consists of a thin layer of a harder grade pressure pad molded integral with the forming pad. This pad is molded when the two urethane compounds are in a liquid state so that they do not separate from each other during the bending process. The harder grade pressure pad has a shorter pot life (time to harden) than the softer grade forming pad. Accordingly, it will be practical to cast the harder grade first on a leveled mold and before this layer hardens completely, the other compound is poured on top of this layer so that there is a good bond therebetween.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention in its broader aspects, and, therefore, the aim in the appended claims is to cover all such changes and modifications as fall within the true spirit and scope of the present disclosure.

What is claimed is:

1. A radius forming system for bending sheet metal with a press brake, the system comprising:

a first pad having a first hardness and sides dimensioned to fit within a bottom die retainer, said first pad further having a top and a bottom;

said bottom of said first pad having a cavity sized relative to a punch;

a second pad having a second hardness wherein said second hardness is greater than said first hardness, said second pad being flat and positioned on said top of said first pad;

said second pad including a loop section overlapping one of said sides of said first pad and having an end coupled to the one of said sides of said first pad whereby when the punch presses the metal against said second pad towards said retainer said first pad is compressed within said cavity and said loop section of said second pad moves towards the punch.

2. The radius forming system as defined in claim 1 wherein said pads are urethane.

3. The radius forming system as defined in claim 1 wherein said first pad has at least one pair of symmetrical relief holes.

4. The radius forming system as defined in claim 3 wherein said relief holes are teardrop shaped.

5. The radius forming system as defined in claim 1 wherein said top of said first pad includes a deformation slot.

6. The radius forming system as defined in claim 1 wherein said coupling end of said second pad includes a key and the one of said sides of said first pad includes a cooperating slot.

7. A sheet metal radius forming system for use in a bending machine, the system comprising:

a first pad having a first hardness and sides dimensioned to fit within a bottom die bed, said first pad further having a top and a bottom;

said bottom of said first pad having a cavity volumetrically proportional to a volume of a punch;

a second pad having a second hardness wherein said second hardness is greater than said first hardness, said second pad being flat, having a bottom with a middle, and positioned on said top of said first pad;

said middle of said bottom of said second pad coupled to said top of said first pad whereby when the punch presses the metal against said second pad towards said bed said first pad is compressed within said cavity and said coupling maintains said positioning of said second pad.

8. The radius forming system as defined in claim 7 wherein said pads are urethane and have different hardness.

9. The radius forming system as defined in claim 7 wherein said first pad has at least one pair of symmetrical relief holes.

10. The radius forming system as defined in claim 9 wherein said relief holes are teardrop shaped.

11. The radius forming system as defined in claim 7 wherein said coupling of said second pad includes a circular key and said top of said first pad includes a cooperating circular slot.

12. A radius forming device for bending sheet metal with a press brake, the device comprising:

a first pad having a first hardness and sides dimensioned to fit within a bottom die retainer, said first pad further having a top and a bottom;

said bottom of said first pad having a cavity volumetrically proportional to a volume of a punch;

said top of said first pad having circular slots for receiving reinforcement rods;

a second pad having a second hardness wherein said second hardness is greater than said first hardness, said second pad being flat, having a bottom with a middle, and positioned on said top of said first pad;

said middle of said bottom of said second pad coupled to said top of said first pad whereby when the punch presses the metal against said second pad towards said bed said first pad is compressed within said cavity and said coupling maintains said positioning of said second pad.

13. The radius forming device as defined in claim 12 wherein said pads are urethane and have different hardness.

14. The radius forming device as defined in claim 12 wherein said coupling of said second pad includes a circular key and said top of said first pad includes a cooperating circular slot.

15. The radius forming device as defined in claim 12 wherein said first pad has at least one pair of symmetrical relief holes.

16. The radius forming device as defined in claim 15 wherein said relief holes are teardrop shaped.

* * * * *